US007722042B2

(12) United States Patent
Cross et al.

(10) Patent No.: US 7,722,042 B2
(45) Date of Patent: May 25, 2010

(54) GAME COMPRISING A PLAYING SURFACE FORMED FROM A RESILIENT MATERIAL

(76) Inventors: Katrina Cross, The Paddock Groby Road, Glenfield, Leicester LE3 8GN (GB); Anthony Cross, The Paddock Groby Road, Glenfield, Leicester LE3 8GN (GB)

( * ) Notice: Subject to any disclaimer, the term of this patent is extended or adjusted under 35 U.S.C. 154(b) by 0 days.

(21) Appl. No.: 12/282,154

(22) PCT Filed: Mar. 9, 2007

(86) PCT No.: PCT/GB2007/000819

§ 371 (c)(1),
(2), (4) Date: Nov. 14, 2008

(87) PCT Pub. No.: WO2007/102009

PCT Pub. Date: Sep. 13, 2007

(65) Prior Publication Data

US 2009/0058005 A1 Mar. 5, 2009

(30) Foreign Application Priority Data

Mar. 9, 2006 (GB) ..... 0604713.8

(51) Int. Cl.
*A63B 71/02* (2006.01)

(52) U.S. Cl. ..... 273/113; 273/109; 273/116; 273/118; 273/441

(58) Field of Classification Search ..... 273/108, 273/109, 113, 115, 116, 118 R, 440, 459, 273/461, 441, 451
See application file for complete search history.

(56) References Cited

U.S. PATENT DOCUMENTS

| | | | | |
|---|---|---|---|---|
| 3,556,527 | A * | 1/1971 | Margolis et al. | 273/115 |
| 3,655,152 | A * | 4/1972 | Bonn et al. | 244/145 |
| 6,129,635 | A * | 10/2000 | Kuo | 472/49 |
| 6,554,277 | B1 * | 4/2003 | Descamps et al. | 273/113 |
| 6,866,269 | B2 * | 3/2005 | Liebau et al. | 273/441 |
| 7,270,327 | B1 * | 9/2007 | Hsu | 273/113 |
| 2003/0080504 | A1 * | 5/2003 | Liebau et al. | 273/109 |
| 2004/0150160 | A1 | 8/2004 | Giegerich | |

FOREIGN PATENT DOCUMENTS

CA 1319375 C 6/1993

OTHER PUBLICATIONS

International Search Report for PCT/GB2007/000819 dated Apr. 7, 2007, 2 pages.

* cited by examiner

*Primary Examiner*—Raleigh W. Chiu
(74) *Attorney, Agent, or Firm*—Paul Y. Feng; Fulwider Patton LLP

(57) ABSTRACT

This invention relates a playing surface (1) for a game that may be played by opposing players or teams of players. The playing surface is formed from a resilient material and may be of polygonal or regular shape. The playing surface is provided with at least one scoring means, for example formed as an opening with a suspended pocket. The playing surface may be formed from a woven textile material into which is incorporated a resilient material such as lycra so that the playing surface as a whole can be stretched and physically deformed in two directions or combinations thereof.

9 Claims, 1 Drawing Sheet

GAME COMPRISING A PLAYING SURFACE FORMED FROM A RESILIENT MATERIAL

CROSS-REFERENCE TO RELATED APPLICATIONS

Figure 1:
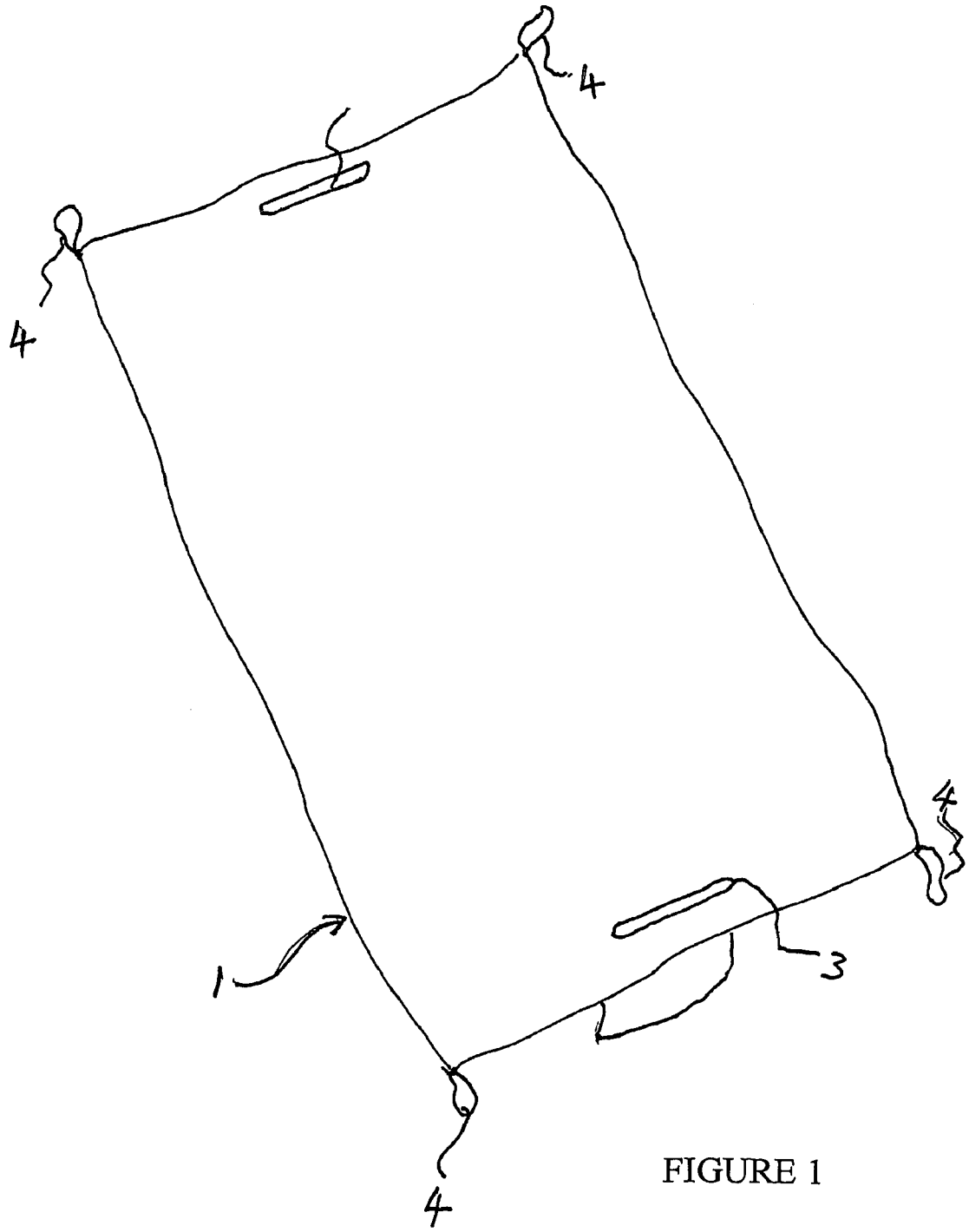

This is a U.S. national phase application of PCT/GB2007/000819, filed Mar. 9, 2007, which claims priority from Great Britain Application No. 0604713.8 filed Mar. 9, 2006, all of whose contents are hereby incorporated by reference.

This invention relates to apparatus for playing a game, and, in particular, to a woven or textile based apparatus that provides a playing surface for playing a game.

One traditional form of entertainment for the children, and some adults, involves playing with bedding items like sheets. The sheet would be folded and the sheet would be manoeuvred, loosened and tightened by holding the corners to either roll or bounce an article, such as a ball, placed thereon, the aim of either keeping the ball in place or alternatively, to push the ball off at the opponents side.

This is not a formal game but an informal/traditional type of entertainment enjoyed at the local level.

The draw back with this type of game is in using a common sheet. Sheets are traditionally made from materials such as cotton or polyester/cotton, which materials are not resilient so the sheet is fixed in shape with little or no ability for manipulation of the actual shape of the playing surface except to loosen or tighten and drop and heighten it to gain an advantage. The game is therefore very one-dimensional and interest is easily lost.

The present invention is concerned with providing an article, and in particular, a playing surface that is adaptable and the shape of which can be manipulated so that it enables the game to be provided with additional features of interest based on the manipulation and the deformation of the material. It formalises the game.

In accordance with the present invention, there is provided a playing surface for a game which playing surface is of a polygonal or regular shape and which playing surface is provided with at least one scoring means, wherein in use the playing surface is supported by the players and the playing surface is formed from a resilient material which can be stretched and physically deformed in two directions or combinations thereof so that whilst playing the game the physical characteristics of the playing surface can be manipulated by the players, so as to alter the shape of the playing surface and the tension in the playing surface.

The advantage with forming the playing surface from a resilient material is that the pitch can be manipulated by stretching, altering the natural shape of the pitch as well as its characteristics thereby adding another dimension to the playing of the game.

The pitch is particularly suited for playing of games involving the use of another article such as a ball, for example a foamed plastic ball, wherein the ball may be placed on the pitch and opposing players stretch and manipulate the pitch as well as heighten and lower the pitch to affect the running of the ball across the pitch, and even bouncing of the ball, within the playing surface, with the aim of getting the ball into the scoring means, or preventing such.

Above mention is made of a foamed plastics ball but it will be appreciated by those skilled in the art that almost any article could be used to play the game, for example, balls solid or inflated, hard or soft. The object could also be almost of any shape such as a flat disc or puck, cube etc or even a soft toy such as a teddy bear.

In one particular example of the present invention, the pitch is formed from a textile based material, such as a woven material, which contains a substantial proportion of lycra/elastine or other elastic behaving material, so providing the material, and therefore the playing surface, with the ability to be stretched and manipulated. Other suitable materials also include hi stretch nylon.

In one arrangement of the present invention the article may be stretchable by up to 10% of its natural length in any given direction, and most preferably up to 25%.

As mentioned above the playing surface is of a polygonal or regular shape, for example a square, rectangle or regular polygon, or of a regular shape such as circular or oval.

The article will be provided with handles at strategic positions, for example the corners or apexes of the playing surface. The handles are provided to enable the players to manipulate the playing surface in a controlled and even manner with regard to the grip on the article.

In one embodiment of the invention, the scoring means comprise openings provided in the playing surface. In one particular embodiment of the invention two scoring means are provided, at or near to the edge of opposing ends/sides of and each scoring means comprises a pocket to catch the article, ball, provided below said opening.

Further with the arrangement in which pockets are provided below the opening of the scoring means the playing surface may be stored in one of the pockets.

The invention also includes the use of a resilient material to manufacture and provide a playing surface for a game, as described above.

The invention will now be described, by way of example, with reference to the accompanying drawing:

FIG. 1 shows one example of an article made in accordance with the present invention.

In the example shown in the drawings, the playing surface is formed as a substantially rectangular woven textile article 1.

The article 1 has two major sides and two lesser sides. In this example the major sides provide the sides of the playing surface extending between opposing players and the lesser sides provided the ends of the playing surface at which the opposing players are located when playing the game. In the lesser sides substantially in the centre thereof and slightly inset therefrom there is provided an opening 2. Each of the openings 2 is set sufficiently inwards of the edge of the playing surface so that the proximity of the edge to the opening 2 does not directly affect the opening configuration. Each of the openings 2 has suspended downwardly therefrom a pocket 3.

Handles 4 may be strategically placed around, or towards the perimeter of the playing surface for the payers of the game to grip and hold. The handles are located at strategic positions with regard to the playing surface, for example at each of the corners of the playing surface. It one arrangement of the invention it is envisaged that the handles will be sown to the playing surface. In an alternative arrangement the handles may be attached by Velcro to the underside of the playing surface. In this alternative arrangement pads may be attached to the underside of the playing surface.

The handles 4 are located to enable the players to manipulate the shape of the playing surface, by the application of a force in a particular direction or the release of a force in a direction. This enables the players to stretch or slacken the playing surface thereby altering the tension in the playing surface, as well as alter the angle of the paying surface.

It should also be remembered that the balance of forces applied to the playing surface will alter the characteristics of the playing surface, for example tension, angle, and may create preferential run lines for the article. In addition the balance of forces will also alter the exact shape of the opening to the scoring means, for example closing and effectively sealing the opening or alternatively broadening the opening to enable scoring. Therefore the balancing and adjusting of these forces in effect provides the striking power and goal-keeping power of the player. Further the skill in playing the game is being able to modify, alter and adjust the level of forces and the angle at which they are introduced into the playing surface to modify the shape of the opening to the scoring means as well as controlling the roll or even bouncing of the article on or with the playing surface to score.

From the above it is clear that the reflexes and speed with which a player can adjust and alter the playing surface are critical to the skilful playing of the game. In addition this means that at a good skill level the game is very energy based and provides a good work out, particularly for the cardiovascular system.

The playing surface is formed from a material preferably a woven material with a high content of lycra material or other resilient/elastic thread woven therein. The material is substantially resilient readily returning to its natural shape and may be stretched in either its longitudinal or lateral directions or combinations thereof. Further if the playing surface is formed with a high content of synthetic material such as nylon so that the material does not actually wet and will readily allow any, moisture thereon to evaporate or be shaken off. This provides the playing surface with a further advantage in that the game may be played with dry, wet or damp articles for example at the beach or even in a wet environment such as in the sea or in a swimming pool.

When playing the game, a player or team of players holds the appropriate handles 4 provided, for example on opposite sides. The playing surface is held clear of the ground or other support surface and is not provided with any other support so that the material of the playing surface and any similar material strengthening means solely form the playing surface.

Normally the game will be played with opposing players or teams of players. Each team having a scoring means with a respective opening 2 that is disposed near to them that they have to defend. The opposing player or team of players will be holding the other handles 4.

An article such as a foamed rubber ball is introduced on to the surface to start the game. The player or teams of players then manipulate the playing surface via heightening or lowering or stretching or releasing tension from a particular direction. In this manner the pitch is manipulated and the characteristics of that pitch are altered so that the track of a ball rolling or bouncing across the surface is affected. The aim would be to roll the ball into your opponent's opening, so scoring. In addition, the provision of the resilient material to provide the pitch also means that the shape of the opening can be altered, for example via applying tension across the opening, i.e., stretching with a component running across from either of the hands would affect to close the opening and prevent scoring, whereas release of tension from the opposing player may seek to release the opening, enabling scoring.

Not shown in the drawings, is marking of the playing surface, but clearly each and every playing surface could be marked in a suitable fashion to mimic a pitch such as a football pitch, ice hockey rink and any other suitable pitch.

The invention claimed is:

1. A playing surface for a game which playing surface is of a polygonal or regular shape and which playing surface is provided with at least one scoring means substantially in the form of a slit, wherein in use the playing surface is supported by the players and the playing surface is formed from a resilient material which can be stretched and physically deformed in two directions or combinations thereof so that whilst playing the game the physical characteristics of the playing surface can be manipulated by the players, so as to alter the shape of the playing surface and the tension in the playing surface and to alter the shape of the scoring means between an open position in which objects may pass into the scoring means and a closed position in which the scoring means is effectively sealed to prevent objects passing thereinto.

2. A playing surface as claimed in claim 1, wherein the playing surface is formed from a textile based material.

3. A playing surface as claimed in claim 2, wherein the textile board material contains a substantial proportion of lycra/elastine.

4. A playing surface as claimed in claim 2, wherein the playing surface is formed as an oval or circle.

5. A playing surface as claimed in claim 1, wherein the article can be stretched by up to 25% of its size.

6. A playing surface as claimed in claim 1, wherein the article can be stretched by up to 10% of its size.

7. A playing surface as claimed in claim 1, wherein the playing surface is formed as a regular polygonal shape.

8. A playing surface as claimed in claim 1, wherein handles are provided.

9. A playing surface as claimed in claim 1, wherein the scoring means comprises openings provided at opposing ends of the playing surface, at or near to the edge of the playing surface and a pocket to catch the article, ball, is provided below said opening.

* * * * *